United States Patent [19]

Modzak

[11] Patent Number: 4,828,499

[45] Date of Patent: May 9, 1989

[54] APPARATUS FOR CONSTRUCTING CROSSWORD PUZZLES

[76] Inventor: Stella M. Modzak, 5138 W. Grace St., Chicago, Ill. 60641

[21] Appl. No.: 86,684

[22] Filed: Aug. 18, 1987

[51] Int. Cl.[4] ..... A63F 9/00

[52] U.S. Cl. ..... 434/177; 273/153 R

[58] Field of Search ..... 434/177, 422, 429; 273/153 R

[56] References Cited

U.S. PATENT DOCUMENTS

| | | | |
|---|---|---|---|
| 111,717 | 2/1871 | Baade | 434/422 |
| 1,578,554 | 3/1926 | Seligman | 273/153 R |
| 2,055,159 | 9/1936 | Scofield | 273/153 R |
| 2,168,551 | 8/1939 | Alexander | 273/153 R X |
| 2,795,863 | 6/1957 | Warwick | 434/177 |

FOREIGN PATENT DOCUMENTS

| | | | |
|---|---|---|---|
| 443726 | 5/1927 | Fed. Rep. of Germany | 434/177 |
| 820904 | 11/1937 | France | 434/177 |
| 465979 | 5/1937 | United Kingdom | 434/177 |
| 569156 | 5/1945 | United Kingdom | 434/177 |
| 1446840 | 8/1976 | United Kingdom | 434/177 |

*Primary Examiner*—Albert J. Makay
*Assistant Examiner*—Allen J. Flanigan
*Attorney, Agent, or Firm*—Emrich & Dithmar

[57] ABSTRACT

An apparatus for constructing crossword puzzles includes a two-piece housing including a base portion and a cover portion, the base portion including a work area surface of metal or the like for receiving one of a plurality of grid members which defines a rectangular grid of squares extending in rows and columns thereon, the grid member being secured to the work area surface by a plurality of magnetic corner pieces, and a crossword puzzle being developed on the grid member using magnetic letters and blank spacer pieces which are normally stored in compartments defined by the base portion of the housing.

11 Claims, 2 Drawing Sheets

FIG. 1
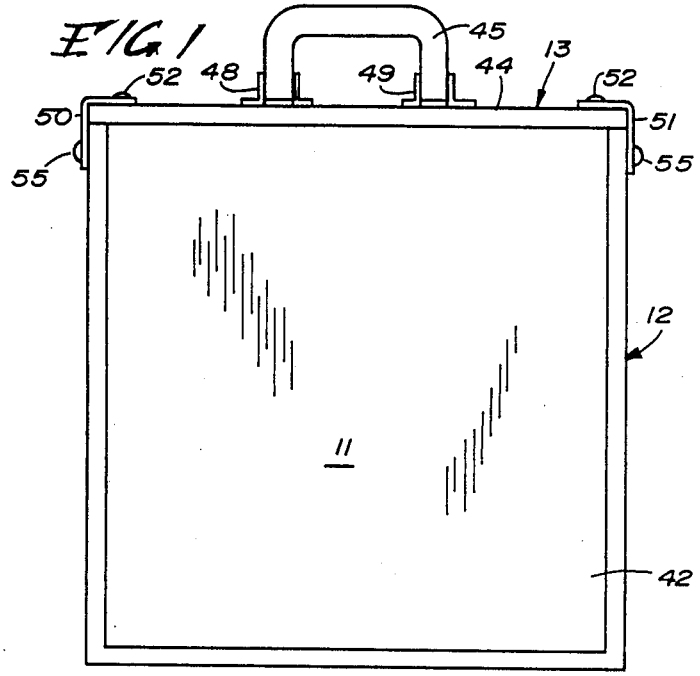
FIG. 2
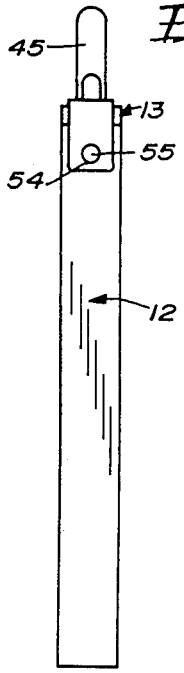
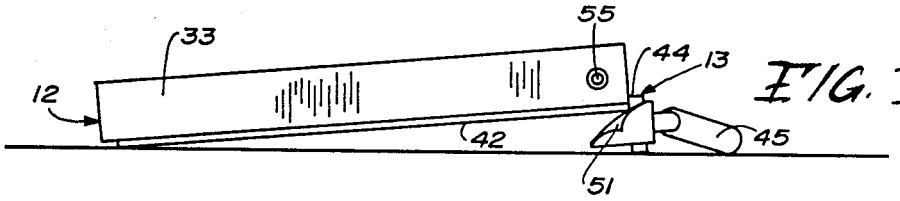
FIG. 3
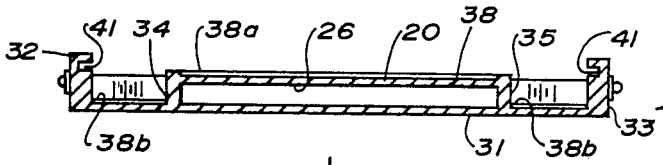
FIG. 5
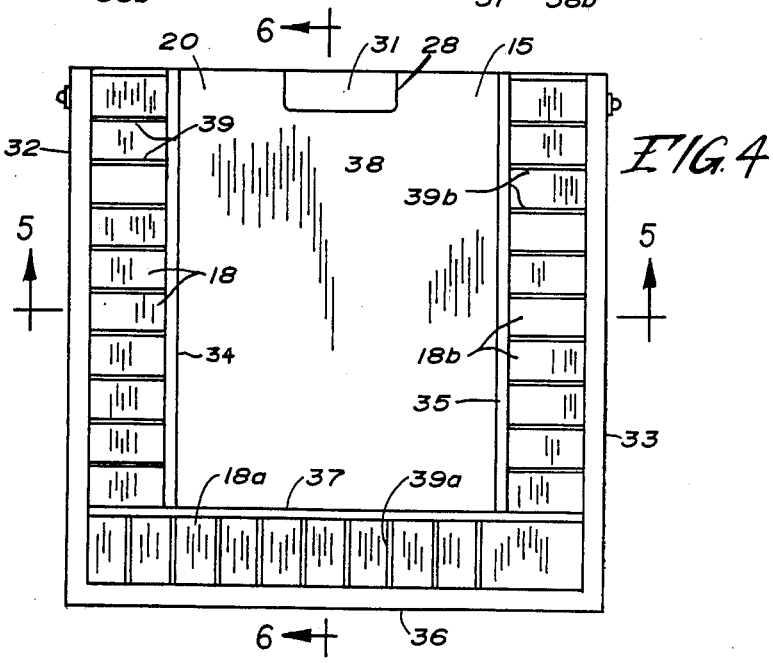
FIG. 4
FIG. 6
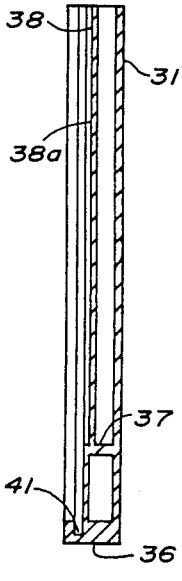

APPARATUS FOR CONSTRUCTING CROSSWORD PUZZLES

BACKGROUND OF THE INVENTION

This invention relates to a system and apparatus for generating crossword puzzles.

Various mechanical-type apparatus has been proposed for constructing crossword puzzles. One such apparatus, disclosed in the U.S. Pat. No. 2,050,498 to Mitchell, includes a board which is divided into squares forming a 25×25 grid and a plurality of markers which are interchangeably positionable on the board to form a crossword puzzle. The markers are small square elements made of cardboard or wood and some of the markers bear indicia representing the letters of the alphabet are placed on the board in a desired pattern and with the letters forming the words in horizontal and vertical patterns. Other markers are colored solid and are used to define the pattern of the puzzle, including spaces between words. Although this arrangement provides a crossword puzzle constructing apparatus which is reusable by virtue of its repositionable elements, no provision is made for securing the elements on the board.

The U.S. Pat. No. 4,205,852 to Wayman, discloses a crossword puzzle constructing apparatus including a game board and letter bearing pieces used in forming crossword puzzles wherein the magnetic effect is used to secure the letter bearing pieces on the game board. The game board is made of a material to which magnets adhere and the letter bearing pieces are magnets which adhere to the game board when placed thereon. The U.S. Pat. No. 2,782,530 to Larroca discloses an arrangement for securing pattern forming elements of a crossword puzzle constructing apparatus to a work surface. The apparatus includes a frame which defines a plurality of seats for interchangeable elements, some of which are apertured and others of which are colored black. The elements are arranged on the frame in the desired pattern. An apertured mask, which is hingedly attached to the frame, is moved into a superposed position over the elements to maintain them in place and with its apertures aligned with those of the elements located beneath the mask. A sheet of paper located beneath the elements has portions exposed to view through the aligned apertures of the elements and mask, and then, crossword puzzle words are written onto the paper through the assembled puzzle structure.

Each of these known crossword puzzle constructing apparatus provide a grid for locating the letters and spacer elements during formation of the crossword puzzle. However, the grid must be large enough to permit a user to work on the largest size crossword puzzle, such as one with a 25×25 grid. One shortcoming of these prior art systems is that the grid arrangements of these prior art systems are fixed, and no provision is made for conveniently generating a smaller puzzle, other than working on a small section of the grid, which can be difficult and confusing to the user.

Another factor is that the crossword puzzle constructing apparatus require a large assortment of letters, for example as many as 100 to 200 of each letter of the alphabet, as well as 100 to 200 spacer elements. Because of the large number of elements required, typically in the order of 3,000, it would be desirable to have a convenient storage arrangement for the elements.

SUMMARY OF THE INVENTION

It is an object of the present invention to provide an improved crossword puzzle constructing apparatus.

Another object of the present invention is to provide a crossword puzzle constructing apparatus which is readily adaptable for construction of crossword puzzles of different sizes.

A further object of the invention is to provide a crossword puzzle forming apparatus which is convertible between a storage unit and a working unit.

These and other objects have been achieved by the present invention which has provided an apparatus for constructing crossword puzzles comprising a housing including a base portion and a cover portion, the base portion constructed and arranged to receive the cover portion thereon, the base portion including means defining a countersunk work area surface having magnetic attracting properties, a plurality of grid members each defining a different rectangular grid having a different plurality of squares of a given size extending in rows and columns therein, means removably securing a selected one of the grid members to said countersunk work area surface, a plurality of work pieces of magnetic material removable positionable on the work area surface, the work pieces including solid colored work pieces for defining a puzzle pattern, and further work pieces bearing indicia representative of letters of the alphabet and arranged on the grid member to define words extending in the rows and columns defined by the grid member the base portion including means defining a plurality of compartments for storing the work pieces when they are not in use, and the cover portion including means to enclose the upper part of the base portion to cover the compartments enclosing the work pieces therewithin.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 1 is a top plan view of a crossword puzzle constructing apparatus provided by the present invention;

FIG. 2 is a side elevation view of the crossword puzzle constructing apparatus;

FIG. 3 is a view of the crossword puzzle constructing apparatus with the cover removed and shown in its application as a support for the bottom section of the apparatus;

FIG. 4 is a top plan view of the bottom section of the apparatus illustrating the storage compartments and working area;

FIG. 5 is a sectional view taken along the lines 5—5 of FIG. 4;

FIG. 6 is a sectional view taken along the line 6—6 of FIG. 4;

FIGS. 12, 12*a* and 12*b* illustrate steps in the generation for a pattern for a crossword puzzle.

DESCRIPTION OF A PREFERRED EMBODIMENT

Referring to FIGS. 1–3, the crossword puzzle constructing apparatus 10 provided by the present invention includes a housing 11 having a base portion 12 and a cover portion 13 constructed and arranged for removable mounting on the base portion.

Figures 8, 9, 10, 11:
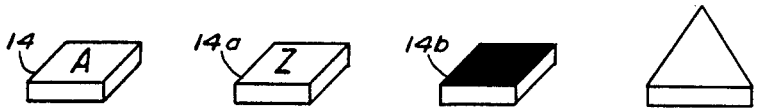
FIGS. 8–10 illustrate work pieces of the apparatus.
FIG. 11 illustrates a corner piece used for securing the grid to the working area.

The base portion 12 defines a countersunk work area space 15 in which the crossword puzzles are developed using work pieces, such as work pieces 14, 14*a*, 14*b* illustrated in FIGS. 8–10, respectively. As is apparent, 26 different work pieces, such as work pieces 14 and 14*a*, are provided, each bearing indicia representing a different letter of the alphabet. By way of example, 100 to 200 of each letter may be provided to enable the user to construct large crossword puzzles. The work pieces 14*b* (FIG. 10) are blank spacer elements used to form the puzzle pattern and provide space between words within the body of the crossword puzzle. By way of example, 100 to 200 spacer elements may be provided. When not in use, the work pieces are stored in storage compartments located around work space 15.

The countersunk work space 15 includes a planar member 20 of a material to which magnets adhere. The work pieces are in the form of magnets.

Figure 7:
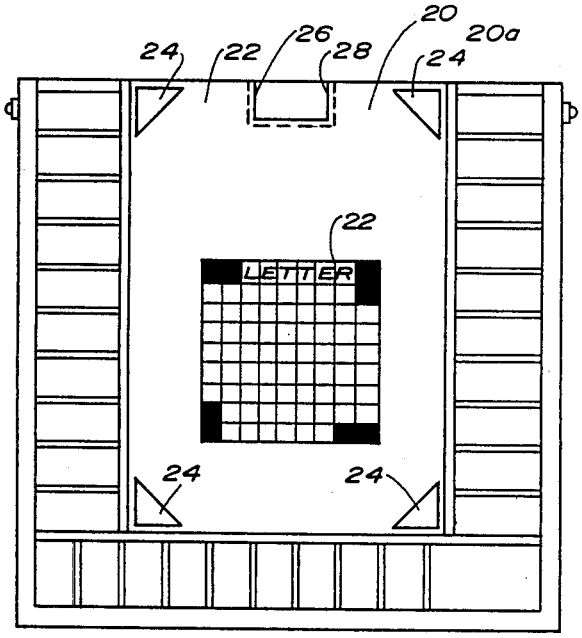
FIG. 7 is a view similar to FIG. 4 with a grid in place on the countersunk working area.

The crossword puzzle constructing apparatus 10 further includes a plurality of grid members, such as grid member 22 shown in FIG. 7, which is positioned on the upper surface of the planar member 20 while a crossword puzzle is being constructed. A plurality of such grids are provided and by way of example nine sizes of crossword puzzle grids are provided each providing a square grid of different sizes including 9×9, 11×11, 13×13, 15×15, 17×17, 19×19, 21×21, 23×23 and 25×25. The grid members are preferably of letter size (8½×11) paper sheets regardless of pattern sizes. The grid member selected for use in constructing a given crossword puzzle is placed on the upper surface of the planar member 20, as shown in FIG. 7, and held in place by four corner pieces 24 (FIG. 11) of magnetic material, which secure the grid member to the planar member 20. The unused grids are stored in a compartment 26, shown best in FIG. 5, beneath the planar member 20. A cut-out 28 in the upper edge 20*a* of the planar member 20 facilitates removal of the grid members stored within the compartment 26.

Considering the housing 11 in more detail, with reference to FIGS. 4–6, the base section 12 includes a planar base member 31, left and right outer wall members 32 and 33 respectively, left and right inner wall members 34 and 35 respectively, an outer bottom wall member 36, an inner bottom wall member 37, and a work area board 38.

The base portion 12 may be made of any suitable rigid material such as wood, plastic, heavy cardboard or metal. When made of plastic, for example, the base portion 12 may be molded as a one-piece unit. When made of wood or cardboard for example, the various elements which form the base portion 12 are assembled together in a suitable manner as by gluing the parts together, nailing the parts together, stapling the parts together, etc.

As shown in FIG. 4, a plurality of divider elements 39 extend between the left outer and inner side walls 32 and 34 dividing the space therebetween into a plurality of compartments 18. Similarly, dividers 39*a* extend between the bottom outer and inner walls 36 and 37 defining compartment 18*a*, and a plurality of dividers 39*b* extend between right outer and inner side walls 33 and 35 defining compartments 18*b*.

The countersunk planar member 20 is shown by way of example as being formed integrally with the inner side walls 34, 35 and 37. The planar member 20 includes an upper layer 38*a* of a material having a high magnetic permeability. Similar material may be disposed on the bottom, sides and divider surfaces of the compartments 18*a* and 18*b*, as shown at 38*b* in FIG. 5, for retaining the work pieces stored therein.

The inner surfaces of the outer wall members 32, 33 and 36 are provided with a horizontally extending notch 41 near their upper edges which receive the cover portion 13 when the cover is mounted on the base portion 12.

With reference to FIGS. 1–3, the cover portion 13 includes a cover plate 42 an outer side piece 44, and a handle 45. The cover plate 42 is a flat planar member generally rectangular in shape and adapted to fit into grooves formed in the inner surfaces of the side and bottom wall members of the base section 12. The outer wall 44 is attached to and depends from the cover member 42 along one edge thereof and corresponds in length to the length of the base portion 12 as shown in FIG. 1. The handle 45 is pivotally mounted to the outer surface of the member 44 by two pair of brackets 48 and 49.

For the purpose of latching or securing the cover portion 13 to the base portion 12, the cover portion includes a pair of latch members 50 and 51 at opposite corners at opposite edges thereof and secured thereto by rivets 52. The members 50 and 51 are of a flexible but strong material such as plastic and provided at its free end with an aperture 54 through which project the studs 55 mounted on the side walls of the base portion 12.

When the cover portion 13 is mounted on the base portion 12, as shown in FIG. 1, the cover plate 42 overlies the compartments 18, 18*a* and 18*b* and the side rail 44 encloses the open forward end of the base portion 12, closing the grid storage compartment 26. During use of the apparatus 10, the cover portion 13 is removed and placed beneath the base portion 12 as illustrated in FIG. 3. The cover portion defines an inclined support for the base portion 12, enhancing access to the work area 15 and to the storage compartments 18, 18*a* and 18*b* for the user.

The work area is countersunk so that when the cover top is placed over the bottom section, and you have a puzzle in progress, the puzzle will not be disturbed because it will be below the surface of the cover.

With reference to FIG. 7, to construct a crossword puzzle, a grid member is selected an placed on the surface of the work area board 20 as shown in FIG. 7. By way of example, the 9×9 grid member has been selected. The grid member 22 is held in place by the four corner members pieces 24.

Figures 12, 13, 14:
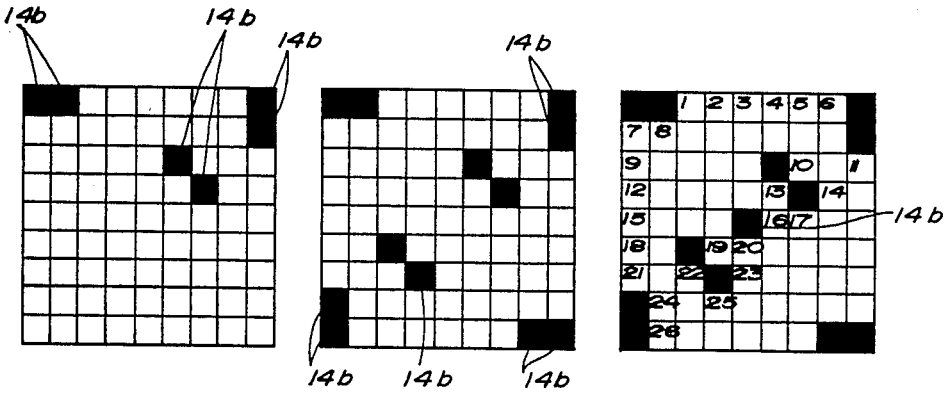

Then a symmetrical pattern is developed on the grid using the solid spacer pieces 14*b* (FIG. 10). By way of example, referring to FIG. 12, the upper half of the puzzle pattern is developed first and as indicated spacer pieces 14*b* have been placed in the upper left corner in the first two positions in the first horizontal row. A second pair of spacer pieces has been placed in the upper right corner in the first and second squares of the right most column of the grid. Two additional spacer members have been placed in columns 6 and 7 in horizontal rows 3 and 4, respectively.

The bottom half of the puzzle is then patterned using the spacer pieces 14*b* as shown in FIG. 12*a* providing a mirror image of the pattern for the upper half of the puzzle pattern. Patterns can also be made (in a mirror image) from right to left or diagonally. Thus, for example, in the lower left-hand corner spacer pieces 14*b* are located in the 8th and 9th rows of the 1st column, and a second pair of spacer pieces 14*b* are located in columns 8 and 9 of row 9. Also, two additional spacer pieces 14*b* are included in columns 3 and 4 in rows 5 and 6, respectively.

To complete the puzzle pattern, a further "common" spacer piece 14*b* is positioned in column 5, row 5, as illustrated in FIG. 12*b*. After the pattern is made, each horizontal line of open, that is unfilled, squares is numbered in sequence from left to right wherever a horizontal and vertical word appears, as illustrated in FIG. 12*b*.

Words are then formed in the thus prepared pattern using the magnetic letters. When the words have been formed in the rows and columns, the definitions are then provided on a separate sheet of paper by the originator. When the puzzle has been completed, the finished crossword puzzle is transferred to a similar size puzzle grid.

After construction of a puzzle has been completed, the letters and space pieces are removed from the grid and placed in their respective storage compartments for future use. The grid member 22 which now includes key numbers unique to the puzzle thus developed, may be used in making a duplicate copy of the puzzle or may be discarded. Photocopies of duplicates of the master grids may be obtained and stored in the grid storage compartment, if desired.

I claim:

1. Apparatus for constructing crossword puzzles comprising: a work assembly including means defining a work area surface having a high degree of magnetic permeability; a grid member of a magnetic pervious material overlying said work area surface; and means removably securing said grid member to said work area surface; said grid member defining a rectangular grid planar surface free of openings therein and having a plurality of squares of a given size extending in rows and columns on said planar surface; and a plurality of work pieces of a magnetic material removably positionable on said work assembly and said planar surface of said grid member, said work pieces including solid colored work pieces positioned on said planar surface of said grid member to define a puzzle pattern and work pieces bearing indicia representative of the letters in the alphabet and arranged on said planar surface of said grid member to define words extending in the rows and columns defined by said grid member to complete the construction of the crossword puzzle.

2. Apparatus according to claim 1, wherein said work assembly comprises a box-like structure including means defining a plurality of compartments spaced along at least one peripheral edge thereof and a flat plate-like member located in the upper center portion of said box-like structure defining said work area surface, said compartments storing said work pieces when they are not in use, and said plate member being rectangular in shape and having a flat upper surface for receiving said grid member, said plate member being of magnetic permeable material, and said means for removably securing said grid member to said work area surface including a plurality of magnets.

3. Apparatus according to claim 2, wherein said securing means comprises a plurality of triangular shaped corner pieces, said grid member being rectangular in shape and being secured to said plate member by said corner pieces.

4. Apparatus according to claim 1, which comprises a plurality of grid members each defining a different rectangular grid having a different plurality of squares.

5. Apparatus for constructing crossword puzzles comprising: a housing including a base portion and a cover portion, said base portion constructed and arranged to receive said cover portion thereon; said base portion including means defining a countersunk work area surface having magnetic attracting properties; a plurality of grid members each defining a different rectangular grid planar surface free of openings thereon and having a different plurality of squares of a given size extending in rows and columns therein on said planar surface; means removably securing a selected one of said grid members to said work area surface;

a plurality of work pieces of magnetic material removable positionable on said work area surface, and on said planar surface of said grid member, said work pieces including solid colored work pieces for defining a puzzle pattern, and further work pieces bearing indicia representative of letters of the alphabet and arranged on said planar surface of said grid member to define words extending in the rows and columns defined by said grid member; said base portion including means defining a plurality of compartments for storing said work pieces when they are not in use; said cover portion including means to enclose the upper part of said base portion to cover said compartments enclosing the work pieces therewithin. of said base portion to cover said compartments enclosing the work pieces therewithin.

6. Apparatus according to claim 5, wherein said cover portion includes means defining an inclined support, said base portion being supported on said inclined support during use of the apparatus in constructing a crossword puzzle.

7. Apparatus according to claim 5, wherein said base portion defines a grid storage compartment for said grid members, said cover portion including a member enclosing said grid storage compartment when said cover portion is mounted on said base portion.

8. Apparatus according to claim 5, wherein said base portion comprises a generally box-like structure including a flat bottom board, first and second side members extending along opposite edges of said board and a bottom member extending between said side members defining therewith a generally C-shaped external wall for said bottom portion, and first and second inner wall members extending in a parallel spaced relation spaced apart from said first and second outer wall members and parallel thereto, and an inner bottom wall member extending between said inner side wall members near first ends thereof, said inner and outer wall members defining a channel therebetween, and means within said channel dividing said channel into a plurality of said storage compartments for said work pieces; said inner side and bottom wall members defining a generally rectangular compartment and supporting a generally rectangular sheet of a rigid magnetically permeable material therewithin defining said countersunk work area surface, said sheet of material spaced above said base board center portion in parallel spaced relation defining a compartment for said grid members.

9. Apparatus according to claim 8, wherein said cover portion comprises a generally rectangular sheet of a rigid material corresponding in length and width substantially to the dimensions of the box defined by said outer side and bottom wall members, said outer side and bottom members each formed with a groove on an inner surface thereof adapted to receive said sheet of said cover portion, and said cover portion further comprising a rail member attached to one end thereof which engages said wall members of said bottom portion near their second ends.

10. Apparatus according to claim 9, further including latching means including means carried by said cover portion and means carried by said outer wall members on outer surfaces thereof for cooperating with said means on said cover portion for latching said cover portion to said base portion.

11. Apparatus according to claim 10, wherein said cover portion further comprises a handle attached to said rail member of said cover portion to facilitate carrying of the apparatus.

* * * * *

UNITED STATES PATENT AND TRADEMARK OFFICE

CERTIFICATE OF CORRECTION

PATENT NO. : 4,828,499

DATED : May 9, 1989

INVENTOR(S) : Stella M. Modzak

It is certified that error appears in the above-identified patent and that said Letters Patent is hereby corrected as shown below:

Column 6, line 41 after the "." delete -- of said base portion to cover said compartments enclosing the work pieces therewithin. --

Signed and Sealed this

Thirteenth Day of February, 1990

*Attest:*

JEFFREY M. SAMUELS

*Attesting Officer*

*Acting Commissioner of Patents and Trademarks*